US007780002B2

(12) United States Patent
Manaster et al.

(10) Patent No.: US 7,780,002 B2
(45) Date of Patent: Aug. 24, 2010

(54) GOLF BAG AND TRAVEL SYSTEM

(75) Inventors: Jacob S. Manaster, Beverly Hills, CA (US); Chip W. Robertson, Pacific Palisades, CA (US); Isaac Manaster, Los Angeles, CA (US)

(73) Assignee: Jettison Products LLC, Pacific Palisades, CA (US)

( * ) Notice: Subject to any disclaimer, the term of this patent is extended or adjusted under 35 U.S.C. 154(b) by 1052 days.

(21) Appl. No.: 11/460,092

(22) Filed: Jul. 26, 2006

(65) Prior Publication Data

US 2008/0023356 A1 Jan. 31, 2008

(51) Int. Cl.
*A63B 55/00* (2006.01)

(52) U.S. Cl. ..... 206/315.3; 206/315.7; 206/315.4; 206/315.8; 150/159

(58) Field of Classification Search ..... 206/315.3, 206/315.4, 315.7, 315.8; 150/159
See application file for complete search history.

(56) References Cited

U.S. PATENT DOCUMENTS

| | | | | | |
|---|---|---|---|---|---|
| 1,461,459 | A | | 7/1923 | Schank | |
| 1,838,699 | A | * | 12/1931 | McMonies et al. | 206/315.6 |
| 1,915,889 | A | * | 6/1933 | Johnsen | 206/315.3 |
| 2,282,842 | A | * | 5/1942 | Abell Harold Q | 248/96 |
| 4,266,589 | A | * | 5/1981 | Cochran | 206/315.3 |
| 4,350,194 | A | | 9/1982 | Brown | |
| 4,798,357 | A | * | 1/1989 | Cho | 248/96 |
| D312,531 | S | | 12/1990 | Sherer et al. | |
| 5,505,300 | A | * | 4/1996 | Joh | 206/315.6 |
| 5,599,037 | A | * | 2/1997 | Spickler | 280/652 |
| D385,421 | S | | 10/1997 | MacDougall | |
| 5,860,519 | A | | 1/1999 | Meyer et al. | |
| 5,950,824 | A | | 9/1999 | Millar, Jr. | |
| 6,161,692 | A | | 12/2000 | Lizarraga | |
| 6,401,890 | B1 | * | 6/2002 | Tan | 190/107 |
| 6,595,356 | B1 | | 7/2003 | Homoly | |
| 7,077,266 | B2 | * | 7/2006 | Dietrich | 206/315.4 |
| 2003/0106817 | A1 | | 6/2003 | Buckley | |

(Continued)

*Primary Examiner*—Tri M Mai
(74) *Attorney, Agent, or Firm*—Steptoe & Johnson LLP

(57) ABSTRACT

A golf bag and travel system for providing a multi-component, modular golf bag that enables golf clubs to be carried therein. The system includes a rigid inner body core and a plurality of modular, interchangeable, soft outer body members. The rigid inner body core includes a rigid top loop region, a rigid central loop region, a rigid bottom end, and a rigid belly region that connects the top loop region, the central loop region, and the bottom end. Each soft outer body member is selectively attachable to the top loop region, bottom end, and belly region of the inner body core, since each soft outer body member is shaped and sized to be selectively attachable to the correspondingly shaped and sized rigid inner body core. A cross-sectional area of the central loop region is smaller than a cross-sectional area of the top loop region, and a cross-sectional area of the central loop region is smaller than a cross-sectional area of the bottom end. As a result, a non-protruding zone is bounded by an outer perimeter of the top loop region that extends longitudinally to an outer perimeter of the bottom end of the inner body core. Each soft outer body member includes one or more storage areas. The smaller cross-sectional area of the central loop region enables a majority of at least one of the storage areas in a soft outer body member to be contained within the non-protruding zone.

21 Claims, 4 Drawing Sheets

U.S. PATENT DOCUMENTS

2003/0146120 A1 8/2003 Chi
2004/0226839 A1* 11/2004 Su ..... 206/315.8
2006/0201832 A1* 9/2006 Tan ..... 206/315.8
2006/0272967 A1* 12/2006 Bremner ..... 206/315.3

* cited by examiner

GOLF BAG AND TRAVEL SYSTEM

FIELD OF THE INVENTION

This invention relates generally to a golf club travel bag and, more particularly, to a golf club travel bag that is configured for containing and transporting golf clubs within a golf club bag along with other related items.

BACKGROUND OF THE INVENTION

A typical golf bag is adapted to hold a set of golf clubs. Usually, the golf bag also includes side pockets for storing a supply of golf balls, as well as other related items. Since a loaded golf bag is fairly heavy, it often includes either a shoulder strap or wheels for transportation purposes on the golf course. Sometimes a golf bag is also provided with a handle so that it can be carried in the same manner as a piece of luggage.

A variety of golf club travel bags are known in the art. The travel bags range from thin nylon shells to hard cover cases. The thin nylon shell bags are desirable because they are lightweight and easy to carry. However, the thin nylon shell bags provide little, if any, protection for the golf clubs. In contrast, the hard shell cases provide a great deal of protection for the clubs, and additionally, the hard shell cases are capable of carrying accessory items such as shoes. Although possessing advantages, the hard shell cases can be heavy and generally cumbersome to use.

Golf is played competitively by both professionals and amateurs. Additionally, since golf courses are located throughout the country, many players often have occasion to travel by air to a vacation resort or other remote playing site. Some traditional golf bags are soft and flexible. While these soft bags afford adequate protection to their contents when the bag is placed in the trunk of an automobile or on a golf cart, they are sometimes not acceptable as a piece of luggage to be stored in the luggage-hold of a commercial aircraft where pieces of luggage are stacked one above the other and are subjected to heavy pressures.

As a result, many commercial airlines refuse to accept typically soft golf bags as luggage. Due to luggage carry-on size restrictions, a player cannot carry a golf bag to his seat within the plane since the golf bag is too bulky to be stored under the seat or in an overhead rack. Thus, if air transport is required, a golf bag typically must be placed within a travel container acceptable to commercial airlines.

Padded shell cases have grown in popularity due to their lightweight construction and ability to provide greater protection to the golf clubs than the nylon shell bags. Like the hard shell cases, the padded shell cases are also capable of carrying other items such as shoes. However, to carry other items, the soft shell cases usually utilize outwardly extending pockets that tend to snare during transport, and thus, increase the likelihood that the padded shell cases will tear.

Although a traditional golf travel bag can contain a golf bag and clubs, as well as shoes and some possible clothing items, it is desirable to have a bag which is of reduced susceptibility to damage the contents when thrown and jostled about, as occurs in airport and airline baggage handling. Accordingly, the need exists for a golf bag that is capable of holding all necessary playing equipment, as well as being configured to function as a lockable travel case suitable for additional modes of transportation. This invention clearly fulfills these and other needs.

SUMMARY OF THE INVENTION

Briefly, and in general terms, this invention resolves the above and other problems by providing a golf bag and travel system for providing a multi-component, modular golf bag that enables golf clubs to be carried therein. The system includes a rigid inner body core and a plurality of modular, interchangeable, soft outer body members. Preferably, the rigid inner body core includes a rigid top loop region, a rigid central loop region, a rigid bottom end, and a rigid belly region that connects the top loop region, the central loop region, and the bottom end. A cross-sectional area of the central loop region is smaller than a cross-sectional area of the top loop region, and a cross-sectional area of the central loop region is smaller than a cross-sectional area of the bottom end. As a result, a non-protruding zone is formed that is bounded by an outer perimeter of the top loop region and extends longitudinally to an outer perimeter of the bottom end of the inner body core. Preferably, the top loop region and the central loop region of the inner body core are hollow and each contain a hollow opening, thereby enabling golf clubs to be placed through the hollow openings in the top loop region and central loop region of the rigid inner body core.

The golf bag and travel system also includes a plurality of modular, interchangeable, soft outer body members. Each soft outer body member is selectively attachable to the top loop region, bottom end, and belly region of the inner body core. Additionally, each soft outer body member is shaped and sized to be selectively attachable, one soft outer body member at a time, to the correspondingly shaped and sized rigid inner body core. Further, each soft outer body member includes one or more storage areas. Notably, the plurality of modular, interchangeable, soft outer body members differ from each other in at least one of size, function, or design parameters, which contributes to the utility of their interchangeability. Moreover, the smaller cross-sectional area of the central loop region enables at least part of a storage area of a soft outer body member to be contained within the non-protruding zone. In some embodiments, a majority (or even all) of one or more storage areas of the soft outer body members are containing within the non-protruding zone.

In accordance with one aspect of the invention, the rigid inner body core of the golf bag and travel system further includes a flexible mesh in the non-belly region of the rigid inner body core that connects the top loop region to the central loop region and that connects the central loop region to the bottom end of the system.

In accordance with another aspect of the invention, the golf bag and travel system further includes a bi-pod attached to the belly region of the inner body core. Preferably, the bi-pod includes two selectively ground-engaging legs and has an extended position and a retracted position. The bi-pod assists in supporting the golf bag and travel system in a substantially upright position when the legs are in the extended position. In a preferred embodiment, the legs of the bi-pod are contained completely within the belly region of the inner body core when in the retracted position. Additionally, the bi-pod is operatively associated with an activation system that actuates the legs of the bi-pod from the retracted position to the extended position when the activation system is activated.

In accordance with still another aspect of the invention, the inner body core of the golf bag and travel system further includes a tightening mechanism that reduces the size of the hollow opening in at least one of the top loop region and the central loop region of the inner body core, thereby securing any golf clubs in place that have been placed through the hollow openings.

In still another aspect of a preferred embodiment, the size parameters of the soft outer body member include, by way of example only, and not by way of limitation: small, medium, and large. Additionally, in the golf bag and travel system, the functional parameters of the soft outer body member include, by way of example only, and not by way of limitation: light weight, inclement weather, travel, and combinations thereof. Continuing, in the golf bag and travel system, the design parameters of the soft outer body member include, by way of example only, and not by way of limitation: company, theme, course, team, type, and combinations thereof.

In yet another aspect of a preferred embodiment, the golf bag and travel system further includes a travel base that is attachable to the rigid bottom end of the system. Preferably, the travel base includes retractable wheels. In one embodiment, the golf bag and travel system also includes a travel cap that is attachable to the top loop region of the system for protecting any golf club contained within the golf bag and travel system. In another aspect, the cap is attachable to the base via a flexible sheath that covers and protects the covered portion of the golf bag and travel system. Additionally, the cap is also attachable directly to the base.

Other features and advantages of the invention will become apparent from the following detailed description, taken in conjunction with the accompanying drawings, which illustrate by way of example, the features of the invention.

DETAILED DESCRIPTION OF THE PREFERRED EMBODIMENTS

Figure 3:
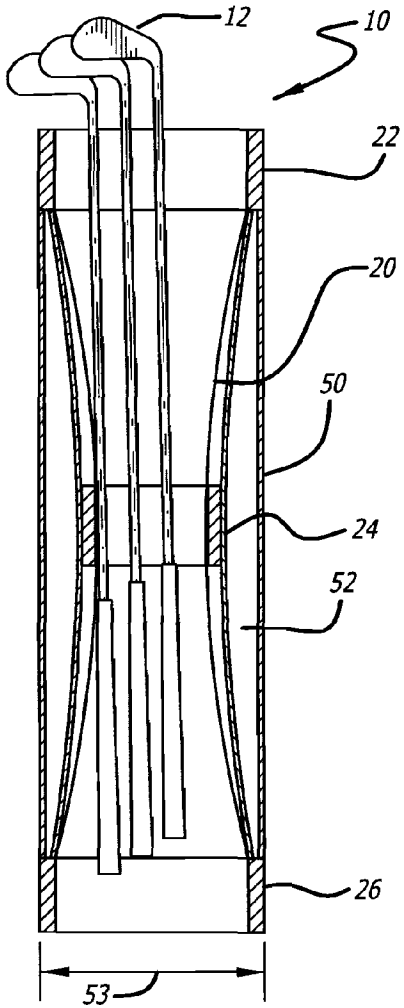
FIG. 3 illustrates a front cross-sectional view of the golf bag and travel system of FIG. 1 with an attached soft outer body member that has a small size parameter and corresponding smaller storage areas completely contained within the non-protruding zone.

A preferred embodiment of the invention is a dual-function, golf bag and travel system adapted as a relatively lightweight carrier for golf clubs to be used by a player on a golf course, and as a lockable travel case that can be safely transported in the luggage hold of a commercial aircraft or otherwise shipped without damage to its contents. The golf bag and travel system provides a multi-component, modular golf bag that enables golf clubs to be carried therein. Referring now to the drawings, wherein like reference numerals denote like or corresponding parts throughout the drawings, and more particularly to FIGS. 1-5, there is shown a golf bag and travel system according to the invention.

Briefly stated, a preferred embodiment of the invention provides a multi-component, modular, golf bag and travel system 10 that includes a rigid inner body core 20 and one or more interchangeable, soft outer body members 50. In one preferred embodiment, as shown in FIGS. 1-5, and in particular with respect to FIG. 4, the rigid inner body core 20 includes a rigid top loop region 22, a rigid central loop region 24, a rigid bottom end 26, and a rigid belly region 28 that connects the top loop region 22, the central loop region 24, and the bottom end 26. Preferably, the rigid inner body core 20 of the golf bag and travel system 10 is composed of polymer, composite, or metallic material (or combinations thereof). Alternatively, other sufficiently rigid and structurally sound materials may also be utilized.

Referring again to FIG. 4, preferably the rigid inner body core 20 additionally includes two or more longitudinal support beams 30 that connect the top loop region 22, the central loop region 24, and the bottom end 26. In another preferred embodiment, the top loop region 22, the central loop region 24, the bottom end 26, and the rigid belly region 28 are all connected as a single unitary part. One of ordinary skill in the art will appreciate that other variations in the level connectivity between the top loop region 22, the central loop region 24, and the bottom end 26 are possible, without departing from the scope of the invention, provided that a sufficient level of structural stability is maintained between the top loop region 22, the central loop region 24, and the bottom end 26 of the rigid inner body core 20.

In another aspect of the preferred embodiment, the cross-sectional area of the central loop region 24 is smaller than the cross-sectional area of the top loop region 22. Additionally, the cross-sectional area of the central loop region 24 is smaller than a cross-sectional area of the bottom end 26. As a result, the shape of the rigid inner body core 20 is substantially "hour-glass" or column-shaped. This "hour-glass" shape creates the potential for pockets 52 (or other types of storage areas) in the soft outer body members 50 to be positioned near the central loop region 24 without protruding beyond the diameter of top loop region 22 or the diameter of bottom end 26. This "non-protruding zone 53" is bounded by the outer perimeter of the top loop region 22 and extends longitudinally to the outer perimeter of the bottom end 26 of the inner body core 20. Notably, the positioning and/or configuration of the pockets 52 on a soft outer body member 50 will vary according to function, design, and/or consumer preference between different preferred embodiments of the golf bag and travel system 10.

Figure 2:
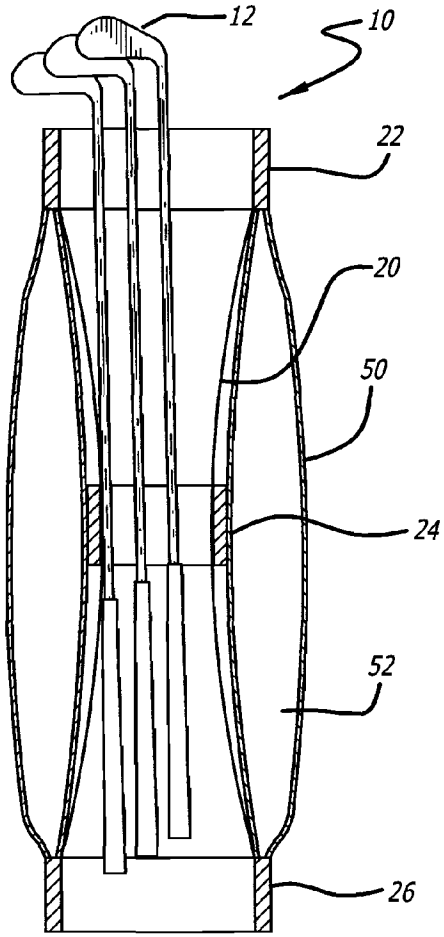
FIG. 2 illustrates a front cross-sectional view of the golf bag and travel system of FIG. 1 with an attached soft outer body member that has a large size parameter and corresponding larger storage areas partially contained within the non-protruding zone.
Figure 1:
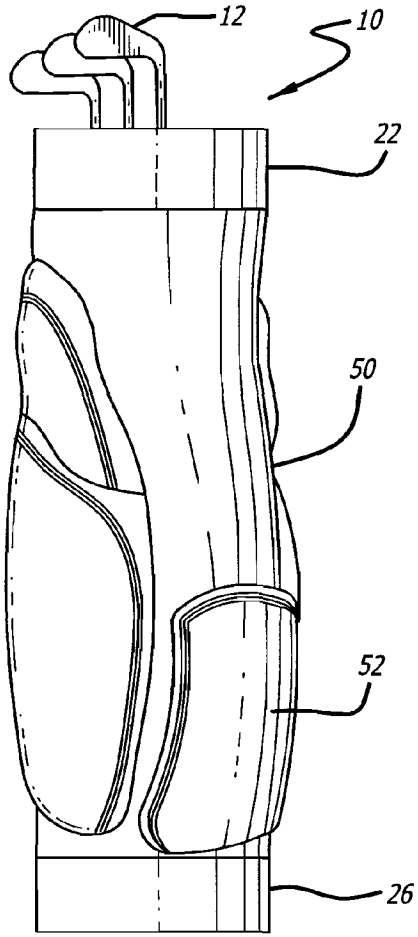
FIG. 1 illustrates a front view of a golf bag and travel system for providing a multi-component, modular golf bag that includes a rigid inner body core and a modular, interchangeable, soft outer body member that is selectively attachable to the rigid inner body core.

As shown in FIGS. 1-3, the top loop region 22 and the central loop region 24 of the inner body core 20 are hollow, each containing a hollow opening. In this manner, the golf bag and travel system 10 enables golf clubs 12 to be placed through the hollow openings in the top loop region 22 and central loop region 24 of the inner body core 20. In contrast, the rigid bottom end 26 of the inner body core 20 is not hollow, but rather is a solid piece of material that contains the golf clubs 12 at the bottom of inner body core 20.

Referring again to FIG. 4, in one preferred embodiment of the golf bag and travel system 10, the rigid inner body core 20 further includes a flexible mesh 32 in the non-belly region of the rigid inner body core 20. The flexible mesh 32 connects the top loop region 22 to the central loop region 24. Additionally, the flexible mesh 32 connects the central loop region 24 to the bottom end 26 of the system 10. This flexible mesh 32 is composed of a sturdy, substantially tear-resistant material in order to be able to withstand potential damage from golf clubs 12 that may sometimes be inserted into the rigid inner body core 20 with unnecessary vigor due to the emotions elicited during the play of golf. As described above, one of ordinary skill in the art will appreciate that other variations in the level connectivity between the top loop region 22, the central loop region 24, and the bottom end 26 are possible, without departing from the scope of the invention. As such, in some embodiments of the golf bag and travel system 10, the rigid inner body core 20 will be completely solid and not include a flexible mesh 32.

Figure 5:
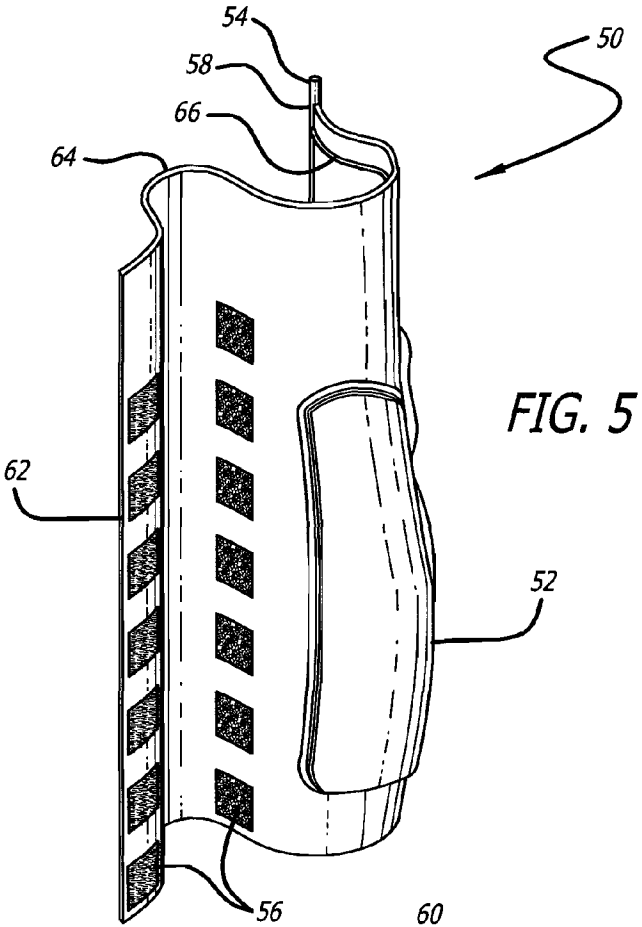
FIG. 5 illustrates a perspective view of only the modular, interchangeable, soft outer body member of a golf bag and travel system, which is shaped and sized to connect to the rigid inner body core shown in FIG. 4.
Figure 4:
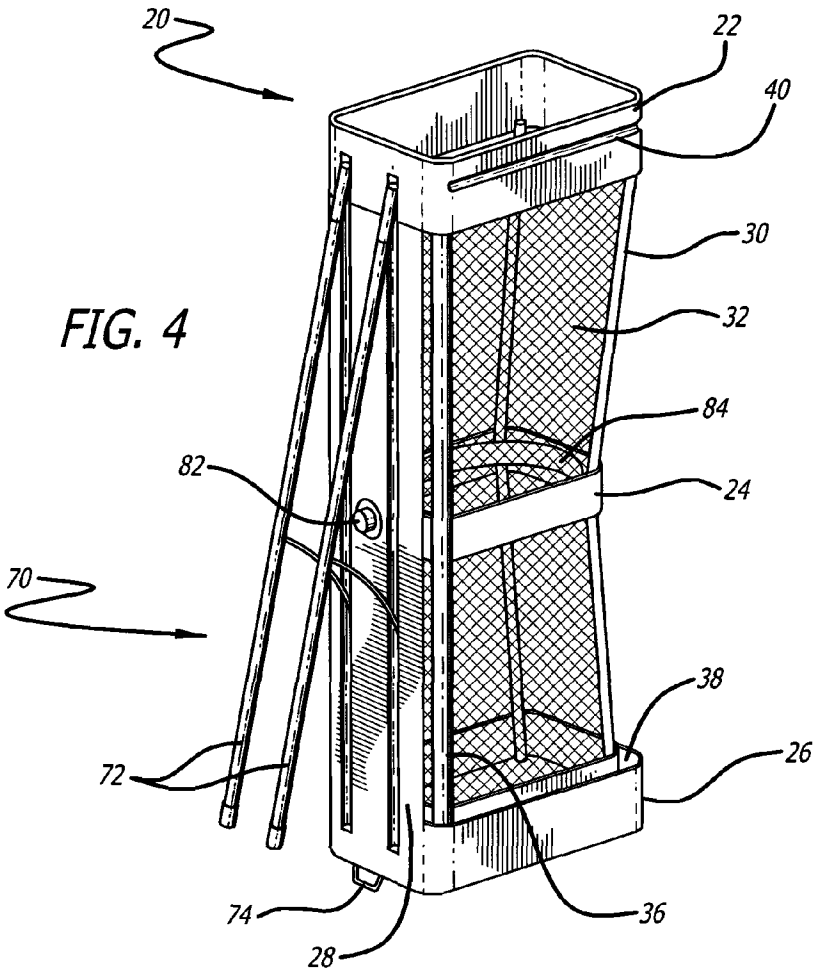
FIG. 4 illustrates a perspective view of only the rigid inner body core of a golf bag and travel system.

Referring now to FIG. 5, a soft outer body member 50 is shown. In one preferred embodiment of the golf bag and travel system 10, one soft outer body member 50 is selected (at a time) from amongst a plurality of modular, interchangeable, soft outer body members 50 for attachment to the rigid inner body core 20. Preferably, each soft outer body member 50 is selectively attachable to the inner body core 20. In one specific, non-limiting embodiment, each soft outer body member 50 is selectively attachable to the top loop region 22, the bottom end 26, and the belly region 28 of the inner body core 20. As shown in FIGS. 4 and 5, each soft outer body member 50 is shaped and sized to be selectively attachable, one soft outer body member 50 at a time, to the correspondingly shaped and sized rigid inner body core 20. Otherwise stated, one soft outer body member 50 correspondingly mates with one rigid inner body core 20 to produce a complete golf bag.

Referring now to FIGS. 6A-6D, in a preferred embodiment of the golf bag and travel system 10, the selective attachment and corresponding mating of a soft outer body member 50 with a rigid inner body core 20 is shown in a four step process from a top cross-sectional view. As shown in FIGS. 6A-6D (and partially in FIG. 4), the rigid inner body core 20 of the golf bag and travel system 10 includes a longitudinally extending channel 34 and a longitudinally extending rod 36 for facilitating the connection of the soft outer body member 50 to the rigid inner body core 20. Preferably, the longitudinally extending channel 34 and the longitudinally extending rod 36 are located in or adjacent to the rigid belly region 28 of the inner body core 20. Correspondingly, as shown in FIGS. 6A-6D (and partially in FIG. 5), the soft outer body member 50 of the golf bag and travel system 10 includes a longitudinally extending shaft 54 and mating longitudinally extending hook and loop surfaces 56 for facilitating the connection of the soft outer body member 50 to the rigid inner body core 20.

In one preferred embodiment, the longitudinally extending shaft 54 of the soft outer body member 50 is inserted into the longitudinally extending channel 34 of the rigid inner body core 20. This secures the first longitudinal end 58 of the soft outer body member 50 to the rigid inner body core 20. In one embodiment, the longitudinally extending shaft 54 of the soft outer body member 50 is slid downward (with reference to FIG. 4) into, and along the length of, the longitudinally extending channel 34 of the rigid inner body core 20. In one such preferred, non-limiting embodiment, the bottom edge 60 of the soft outer body member 50 slides into an upward facing channel 38 at the bottom end 26 of the rigid inner body core 20. In another preferred embodiment, the bottom edge 60 of the soft outer body member 50 attaches to the bottom end 26 of the rigid inner body core 20 using other fastening techniques, which are known in the art.

Continuing, the soft outer body member 50 is pulled taut around the perimeter of the rigid inner body core 20 and then cinched around longitudinally extending rod 36 of the inner body core 20, enabling the longitudinally extending surfaces 56 to secure against each other and firmly connect this second longitudinal end 62 the soft outer body member 50 to the belly region 28 of the rigid inner body core 20. In one preferred, non-limiting embodiment, the top edge 64 of the soft outer body member 50 contains an inward-facing protrusion 66 that is press-fit into an outward facing channel 40 along the top loop region 22 of the rigid inner body core 20. Alternatively, in another preferred embodiment, the soft outer body member 50 attaches to the rigid inner body core 20 via two channels instead of one channel. In another preferred embodiment, the top edge of the soft outer body member 50 attaches to the top loop region 22 of the rigid inner body core 20 using other fastening techniques, which are known in the art.

Referring now to FIGS. 1-3, 5, and 6A-6D, in one preferred embodiment of the golf bag and travel system 10, each soft outer body member 50 includes one or more pockets 52 or other types of storage areas. As described above, the "hourglass" shape of the rigid inner body core 20 creates the potential for these pockets 52 (or other types of storage areas) to be positioned near the central loop region 24 without protruding beyond the diameter of top loop region 22 or the diameter of the bottom end 26 (i.e., the "non-protruding zone 53," which is bounded by the outer perimeter of the top loop region 22 and extends longitudinally to the outer perimeter of the bottom end 26 of the inner body core 20). In one preferred embodiment, the smaller cross-sectional area of the central loop region 24 enables at least part of the one or more storage areas of a soft outer body member 50 to be contained within the non-protruding zone 53. In another preferred embodiment, the smaller cross-sectional area of the central loop region 24 enables all of the one or more storage areas 52 of a soft outer body member 50 to be contained within the non-protruding zone 53. This ergonomic design, which reduces or eliminates the protrusion of pockets or other storage areas beyond the non-protruding zone 53, facilitates eases use and transportation of the golf bag and travel system 10 while simultaneously reducing the risk of damage due to the lack of any bulky and/or unwieldy protrusions.

Although only one soft outer body member 50 can be attached to the rigid inner body core 20 at a time, that one soft outer body member 50 is preferably selected from amongst a plurality of modular, interchangeable, soft outer body members 50. In such a preferred embodiment, the plurality of modular, interchangeable, soft outer body members 50 differ from each other in at least one of size, function, or design parameters. In one aspect of a preferred embodiment, the plurality of interchangeable, soft outer body members 50 vary in size parameters that include, by way of example only, and not by way of limitation: small, medium, and large. In this manner, a golfer is able to select a small soft outer body member 50 for a quick local round of golf, and select a large soft outer body member 50 for a destination golf trip, thereby enabling the golfer to easily carry extensive golf paraphernalia on the trip.

In another aspect of a preferred embodiment, the plurality of interchangeable, soft outer body members 50 vary in functional parameters that include, by way of example only, and not by way of limitation: light weight, inclement weather, travel, and combinations thereof. In this manner, a golfer is able to select a lightweight, soft outer body member 50 when the weight of the bag is a primary concern over storage capacity, and select an inclement weather soft outer body member 50 when foul weather is a primary concern. In still another aspect of a preferred embodiment, the plurality of interchangeable, soft outer body members 50 vary in design parameters that include, by way of example only, and not by way of limitation: company, theme, course, team, type, and combinations thereof. In this manner, a golfer is able to select one company or theme in one situation, and then "re-skin" their golf bag for a second company or theme in another situation (without having to switch to a different bag).

With respect to bag type, the golf bag and travel system 10 is capable of being configured as any of several different bag types by interchanging different version of the soft outer body members 50. These bag types include, by way of example only, and not by way of limitation: stand/carry, staff, cart, and lightweight. Stand (or carry) bags are typically carried either over the shoulder or with the "dual strap" style system (e.g., the IZZO dual strap system). This configuration makes significant use of the bipod mechanism described below. The staff bag is a very large bag that is typically used by professionals. Usually a caddy carries this bag, which is often made of leather. The staff bag bag is sometimes used in conjunction with a cart and often does not utilize a bipod mechanism. A cart bag is much like the staff bag, described above, but is usually a little smaller and is typically not made of leather. Lastly, the lightweight bag is usually a type of stand bag that is little smaller and with less pockets or pocket room.

Referring again to FIG. 4, in another aspect of a preferred embodiment, the golf bag and travel system 10 further includes a bi-pod 70 that attaches to the belly region 28 of the inner body core 20. Preferably, the bi-pod 70 attaches internally to the belly region 28 of the inner body core 20 (i.e., the bi-pod 70 does not protrude out from the surface of the belly region 28). The bi-pod 70 includes two selectively ground-engaging legs 72 and has an extended position and a retracted position. The bi-pod 70 assists in supporting the golf bag and travel system 10 in a substantially upright position when the legs 72 are in the extended position. A common problem with bi-pod systems is that the legs have a tendency to become bent or broken (particularly during transportation) due to the manner in which they project out from the main body of a golf bag or other device. However, in a preferred embodiment of the golf bag and travel system 10, the bi-pod 70 and its legs 72 are contained completely within the belly region 28 of the inner body core 20 when the bi-pod 70 is in the retracted position (i.e., the bi-pod 70 does not protrude out from the surface of the belly region 28). This reduces or eliminates the amount of damage to the bi-pod legs 72 when the bi-pod 70 is in the retracted position, particularly during transportation. One of ordinary skill in the art will appreciate that this type of fully-retracted, countersunk bi-pod 70 can be used in conjunction with other devices outside of the field of golf.

Additionally, as shown in FIG. 4, the bi-pod 70 is operatively associated with an activation system that includes a ground-engaging clip 74 which projects downward beneath the bottom end 26 of the rigid inner body core 20. The activation system actuates the legs 72 of bi-pod 70 from the retracted position to the extended position when activated by depressing the clip 74 upwards into the bottom end 26 of the rigid inner body core 20 through contact with the ground or other surface.

Figure 6A:
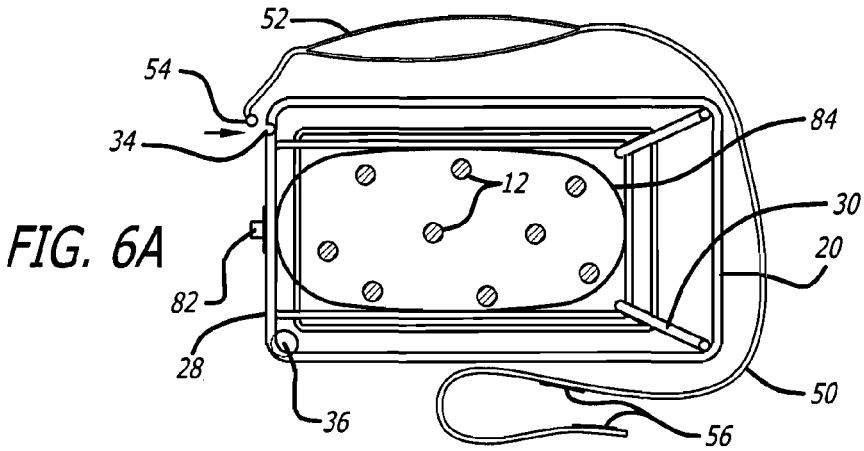
FIG. 6A illustrates a top cross-sectional view of the rigid inner body core of the golf bag and travel system of FIG. 4 with the modular, interchangeable, soft outer body member of FIG. 5 preparing to attach thereto, as well as a tightening mechanism in a loose position.
Figure 6B:
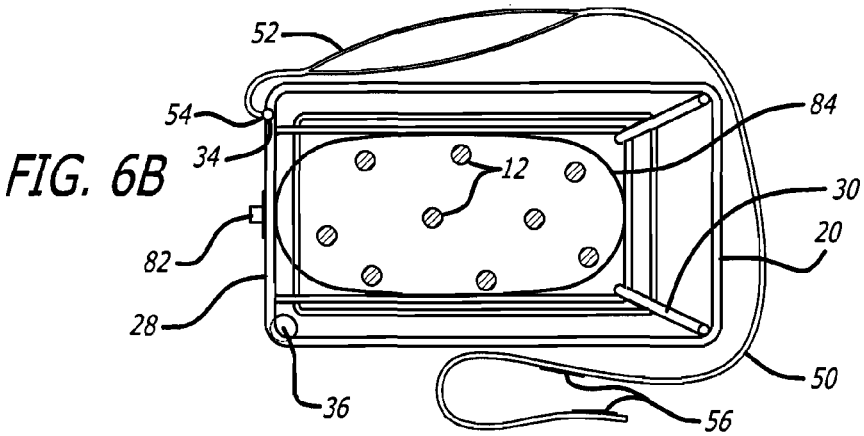
FIG. 6B illustrates a top cross-sectional view of the rigid inner body core of the golf bag and travel system of FIG. 4 with the modular, interchangeable, soft outer body member of FIG. 5 beginning to attach thereto, as well as a tightening mechanism in a loose position.
Figure 6C:
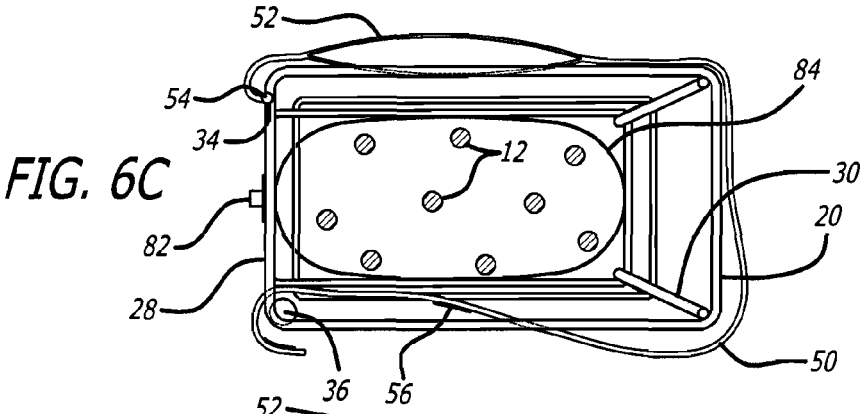
FIG. 6C illustrates a top cross-sectional view of the rigid inner body core of the golf bag and travel system of FIG. 4 with the modular, interchangeable, soft outer body member of FIG. 5 partially attached thereto, as well as a tightening mechanism in a loose position.
Figure 6D:
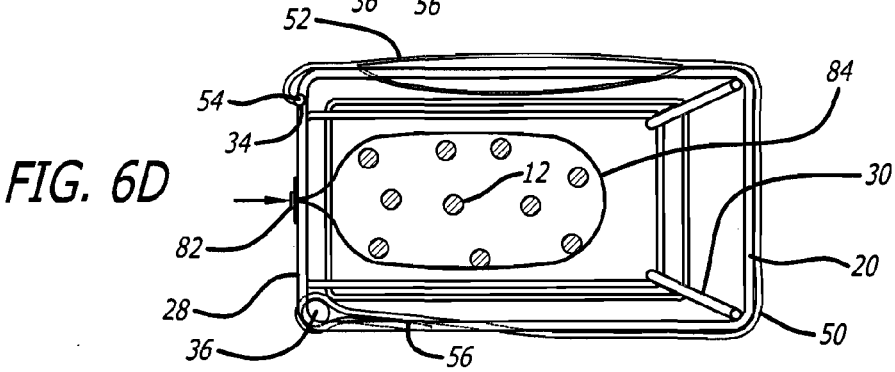
FIG. 6D illustrates a top cross-sectional view of the rigid inner body core of the golf bag and travel system of FIG. 4 with the modular, interchangeable, soft outer body member of FIG. 5 fully attached thereto, as well as a tightening mechanism in a tightened position.

Referring now to FIGS. 4 and 6A-6D, in another aspect of a preferred embodiment, the golf bag and travel system 10 further includes a tightening mechanism 80 that reduces the size of the hollow opening in at least one of the top loop region 22 and the central loop region 24 of the inner body core 20, thereby securing any golf clubs 12 in place that have been placed through the hollow openings. This prevents the golf clubs 12 from rattling against each other during transportation. Additionally, the tightening mechanism 80 assists with the placement of a cap or cover over the end of the club heads. In one preferred embodiment, the tightening mechanism 80 includes a tightening knob 82 and constrictable band 84. The constrictable band 84 is located on the inside of, and associated with, the rigid inner body core 20, preferably at or near the central loop region 24. The tightening mechanism 80 is left in a loose position during normal use of the golf bag and travel system 10, as shown in FIGS. 6A-6C. However, when a golfer plans to transport the golf bag and travel system 10, the tightening knob 82 is turned and the constrictable band 84 contracts to tighten around the shafts of the golf clubs 12 that have been placed in the golf bag and travel system 10. To loosen the constrictable band 84 when desired, the golfer simply turns the tightening knob 82 in the opposite direction.

In another embodiment of the golf bag and travel system 10, the tightening mechanism 80 includes more than one of the constrictable bands 84. In still another embodiment of the golf bag and travel system 10, the tightening mechanism 80 does not include a tightening knob 82 and constrictable band 84, but instead utilizes one or more draw strings, one or more "hook and loop" straps, or other known cinching mechanisms. One of ordinary skill in the art will appreciate that this type of tightening mechanism 80, which including a tightening knob 82 and constrictable band 84, can be used in conjunction with other devices outside of the field of golf (or can be used in conjunction with any type of golf bag).

Figure 7:
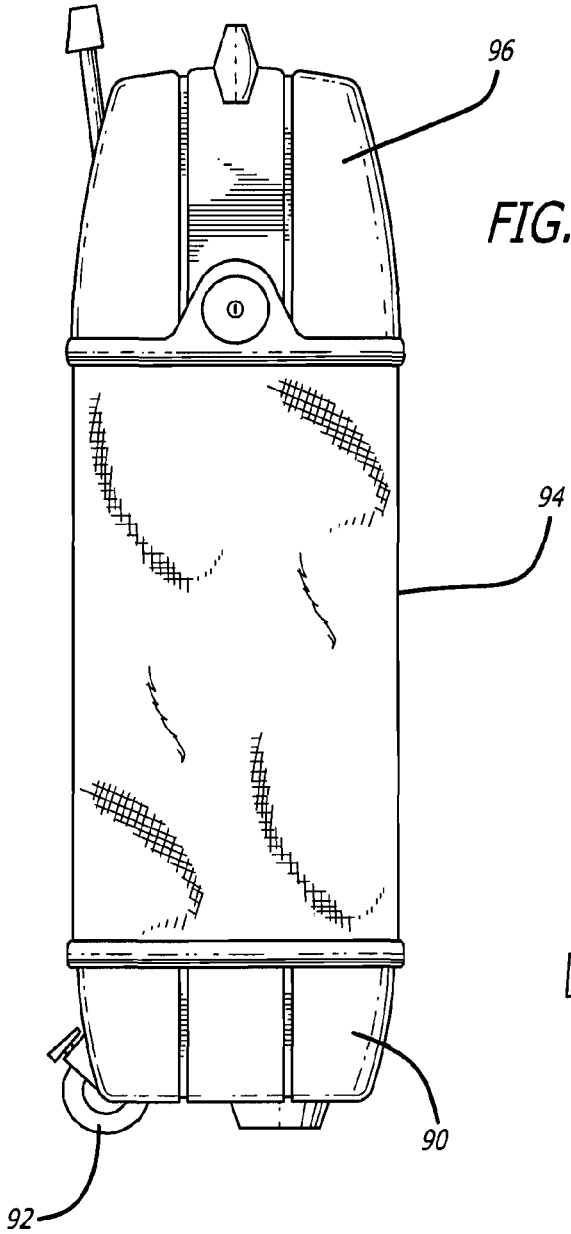
FIG. 7 illustrates a side view of a golf bag and travel system with an attached cap and base that connects via a flexible sheath which protects the rigid inner body core and the modular, interchangeable, soft outer body member.
Figure 8:
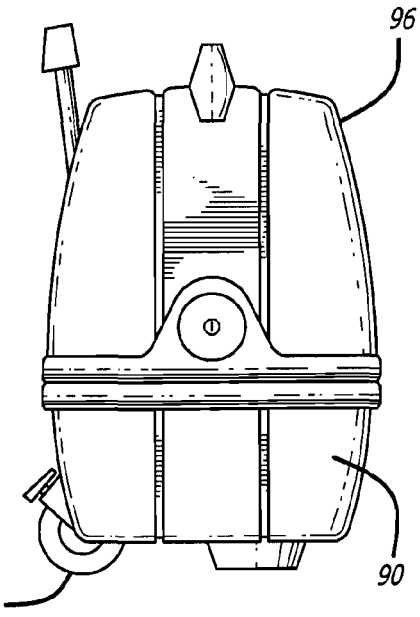
FIG. 8 illustrates a side view of a golf bag and travel system with an attached cap and base that are directly connected for storage purposes without enclosing the rigid inner body core and the modular, interchangeable, soft outer body member.

Referring now to FIGS. 7 and 8, in a preferred embodiment, the golf bag and travel system 10 further includes a travel base 90 that is selectively attachable to the bottom end 26 of the system, and a travel cap 96 that is attachable to the top of the system (e.g., the top loop region 22) for protecting the heads of the golf clubs 12 contained within the golf bag and travel system 10. In one preferred embodiment, the travel base 90 includes retractable wheels 92 for facilitating local transportation of the golf bag and travel system 10. In another preferred embodiment, the travel base wheels are not retractable. In another aspect of a preferred embodiment, the travel cap 96 is attachable to the base via a flexible sheath 94 that covers and connects over the outside of the golf bag and travel system 10. In one preferred embodiment, the sheath is connected to the cap 96 and is selectively attachable to the base 90. In an alternative embodiment, this arrangement is reversed. In this manner, the flexible sheath 94 protects the covered portion of the golf bag and travel system 10. In another aspect of a preferred embodiment, the travel cap 96 is attachable directly to the travel base 90 for storage purposes while the rigid inner body core 20 and the soft outer body member 50 are used elsewhere.

In another aspect of a preferred embodiment, the travel cap 96 contains a liner to assist in preventing damage to the club heads during travel. The liner may be shaped and sized in many different configurations, but typically at least a portion of the liner is soft and/or flexible. In other embodiments, a multi-component liner is utilized. In one particular, non-limiting preferred embodiment, the liner of the travel cap 96 is composed of many gel-filled tentacle-like feelers.

Furthermore, the various apparatus and methodologies described above are provided by way of illustration only and should not be construed to limit the invention. Those skilled in the art will readily recognize that various modifications and changes may be made to the invention without departing from the true spirit and scope of the invention. Accordingly, it is not intended that the invention be limited, except as by the appended claims.

What is claimed:

1. A golf bag and travel system for providing a multi-component, modular golf bag that enables golf clubs to be carried therein, the system comprising:

a rigid inner body core, wherein the rigid inner body core includes a rigid top loop region, a rigid central loop region, a rigid bottom end, and a rigid belly region that connects the top loop region, the central loop region, and the bottom end;

wherein a cross-sectional area of the central loop region is smaller than a cross-sectional area of the top loop region, wherein the cross-sectional area of the central loop region is smaller than a cross-sectional area of the bottom end;

wherein the rigid inner body core further includes a flexible mesh in the non-belly region of the rigid inner body core that connects the top loop region to the central loop region and that connects the central loop region to the bottom end of the system;

wherein the top loop region and the central loop region of the inner body core are hollow and each contain a hollow opening, thereby enabling golf clubs to be placed through the hollow openings in the top loop region and central loop region of the rigid inner body core; and a plurality of modular, interchangeable, soft outer body members, wherein each soft outer body member is selectively attachable to the top loop region, bottom end, and belly region of the inner body core, wherein each soft outer body member is shaped and sized to be selectively attachable, one soft outer body member at a time, to the correspondingly shaped and sized rigid inner body core;

wherein each soft outer body member includes one or more storage areas.

2. The golf bag and travel system of claim 1, further comprising a bi-pod attached to the belly region of the inner body core, wherein the bi-pod includes two selectively ground-engaging legs and has an extended position and a retracted position, and wherein the bi-pod assists in supporting the golf bag and travel system in a substantially upright position when the legs are in the extended position.

3. The golf bag and travel system of claim 2, wherein the legs of the bi-pod are contained completely within the belly region of the inner body core when in the retracted position.

4. The golf bag and travel system of claim 2, wherein the bi-pod is operatively associated with an activation system that actuates the legs of bi-pod from the retracted position to the extended position when the activation system is activated.

5. The golf bag and travel system of claim 1, wherein the inner body core further comprises a tightening mechanism that reduces the size of the hollow opening in at least one of the top loop region and the central loop region of the inner body core, thereby securing any golf clubs in place that have been placed through the hollow openings.

6. The golf bag and travel system of claim 1, further comprising a base that is attachable to the rigid bottom end of the system.

7. The golf bag and travel system of claim 6, wherein the base includes wheels.

8. The golf bag and travel system of claim 1, further comprising a cap that is attachable to the golf bag and travel system for protecting any golf club contained within the golf bag and travel system.

9. The golf bag and travel system of claim 8, further comprising a base that is attachable to the rigid bottom end of the system, and wherein the cap is attachable to the base via a flexible sheath that covers and protects the golf bag and travel system.

10. The golf bag and travel system of claim 9, wherein the cap is attachable directly to the base.

11. A golf bag and travel system for providing a multi-component, modular golf bag that enables golf clubs to be carried therein, the system comprising:

a rigid inner body core, wherein the rigid inner body core includes a rigid top loop region, a rigid central loop region, a rigid bottom end, and a rigid belly region that connects the top loop region, the central loop region, and the bottom end;

wherein a cross-sectional area of the central loop region is smaller than a cross-sectional area of the top loop region, wherein the cross-sectional area of the central loop region is smaller than a cross-sectional area of the bottom end;

wherein the top loop region and the central loop region of the inner body core are hollow and each contain a hollow opening, thereby enabling golf clubs to be placed through the hollow openings in the top loop region and central loop region of the rigid inner body core; and a plurality of modular, interchangeable, soft outer body members, wherein each soft outer body member is selectively attachable to the top loop region, bottom end, and belly region of the inner body core, wherein each soft outer body member is shaped and sized to be selectively attachable to the correspondingly shaped and sized rigid inner body core;

wherein each soft outer body member includes one or more storage areas; and a bi-pod attached to the belly region of the inner body core, wherein the bi-pod includes two selectively ground-engaging legs and has an extended position and the retracted position, and wherein the bi-pod assists in supporting the golf bag and travel system in a substantially upright position when the legs are in the extended position, wherein the legs of the bi-pod are contained completely within the belly region of the inner body core when in the retracted position.

12. The golf bag and travel system of claim 11, wherein the bi-pod is operatively associated with an activation system that actuates the legs of bi-pod from the retracted position to the extended position when the activation system is activated.

13. The golf bag and travel system of claim 11, the inner body core further comprises a tightening mechanism that reduces the size of the hollow opening in at least one of the top loop region and the central loop region of the inner body core, thereby securing any golf clubs in place that have been placed through the hollow openings.

14. The golf bag and travel system of claim 11, further comprising a base that is attachable to the rigid bottom end of the system.

15. The golf bag and travel system of claim 14, wherein the base includes wheels.

16. The golf bag and travel system of claim 11, further comprising a cap that is attachable to the golf bag and travel system for protecting any golf club contained within the golf bag and travel system.

17. The golf bag and travel system of claim 16, further comprising a base that is attachable to the rigid bottom end of the system, and wherein the cap is attachable to the base via a flexible sheath that covers and connects over the outside of the golf bag and travel system.

18. The golf bag and travel system of claim 17, wherein the cap is attachable directly to the base.

19. The golf bag and travel system of claim 11, wherein the rigid inner body core further includes a flexible mesh in the non-belly region of the rigid inner body core that connects the top loop region to the central loop region and that connects the central loop region to the bottom end of the system.

20. A golf bag and travel system for providing a multi-component, modular golf bag that enables golf clubs to be carried therein, the system comprising:

a rigid inner body core, wherein the rigid inner body core includes a rigid top loop region, a rigid central loop region, and a rigid bottom end, wherein a cross-sectional area of the central loop region is smaller than a cross-sectional area of the top loop region, wherein the cross-sectional area of the central loop region is smaller than a cross-sectional area of the bottom end, and wherein a non-protruding zone is bounded by an outer perimeter of the top loop region that extends longitudinally to an outer perimeter of the bottom end of the inner body core;

wherein the top loop region and the central loop region of the inner body core are hollow and each contain a hollow opening, thereby enabling golf clubs to be placed through the hollow openings in the top loop region and central loop region of the rigid inner body core;

at least one modular, soft outer body member, wherein the soft outer body member is selectively attachable to the rigid inner body core, wherein the soft outer body member is shaped and sized to be selectively attachable, one soft outer body member at a time, to the correspondingly shaped and sized rigid inner body core, and wherein the smaller cross-sectional area of the central loop region enables at least part of a soft outer body member to be contained within the non-protruding zone; and a bi-pod attached to the inner body core, wherein the bi-pod includes two selectively ground-engaging legs and has an extended position and a retracted position, wherein the bi-pod assists in supporting the golf bag and travel system in a substantially upright position when the legs are in the extended position, and wherein the legs of the bi-pod are contained completely within the inner body core when in the retracted position.

21. A golf bag and travel system for providing a golf bag that enables golf clubs to be carried therein, the system comprising:

a rigid inner body core, wherein the rigid inner body core includes a rigid top loop region, a rigid central loop region, a rigid bottom end, and a rigid belly region that connects the top loop region, the central loop region, and the bottom end, and wherein the top loop region and the central loop region of the inner body core are hollow and each contain a hollow opening, thereby enabling golf clubs to be placed through the hollow openings in the top loop region and central loop region of the rigid inner body core;

wherein the rigid inner body core further includes a flexible mesh in the non-belly region of the rigid inner body core that connects the top loop region to the central loop region and that connects the central loop region to the bottom end of the system; and a soft outer body member, wherein the soft outer body member is attachable to the rigid inner body core.

* * * * *